US008393093B2

(12) United States Patent
Cleveland et al.

(10) Patent No.: US 8,393,093 B2
(45) Date of Patent: Mar. 12, 2013

(54) METHOD AND TOOL FOR FORMING PICOTS

(76) Inventors: Susan K. Cleveland, West Concord, MN (US); Lee D. Cleveland, West Concord, MN (US)

( * ) Notice: Subject to any disclaimer, the term of this patent is extended or adjusted under 35 U.S.C. 154(b) by 505 days.

(21) Appl. No.: 12/660,020

(22) Filed: Feb. 19, 2010

(65) Prior Publication Data

US 2011/0009252 A1 Jan. 13, 2011

Related U.S. Application Data

(60) Provisional application No. 61/223,606, filed on Jul. 7, 2009.

(51) Int. Cl.
*D06F 81/00* (2006.01)
*A41H 1/00* (2006.01)

(52) U.S. Cl. ..... 36/144; 33/11

(58) Field of Classification Search ..... 33/11–16, 33/492, 483, 17 R; 112/117; 38/89, 141, 38/144, 69

See application file for complete search history.

(56) References Cited

U.S. PATENT DOCUMENTS

| | | | | |
|---|---|---|---|---|
| 235,776 | A * | 12/1880 | Kellogg | 33/13 |
| 568,263 | A * | 9/1896 | Moccia | 33/11 |
| 967,504 | A * | 8/1910 | Eden | 33/16 |
| 4,053,986 | A * | 10/1977 | Axelrod | 33/17 R |
| 6,021,726 | A * | 2/2000 | Muraki | 112/117 |
| 6,276,070 | B1 * | 8/2001 | Hawley | 33/563 |
| D601,442 | S * | 10/2009 | Haren | D10/64 |
| 8,074,384 | B2 * | 12/2011 | Kuwabara | 38/102.2 |
| 2007/0283589 | A1 * | 12/2007 | Garcia | 33/758 |
| 2009/0083984 | A1 * | 4/2009 | Platt | 33/492 |

* cited by examiner

*Primary Examiner* — Ismael Izaguirre
(74) *Attorney, Agent, or Firm* — William J. Ryan

(57) ABSTRACT

A method and tool for forming decorative picots is provided. The tool comprises a triangular substrate having a base and two sides intersecting at an apex, indicia defining a centerline extending from the apex to the midpoint of the base, and indicia defining one or more guidelines extending from one side of the substrate to the other, parallel to the base. The method comprises placing the substrate on a rectangular strip of fabric having a width twice its height, aligning the substrate on the fabric such that the apex is positioned at the midpoint of the top edge of the fabric and the bottom edge is positioned parallel to the base of the substrate, folding the top edges of the fabric over the substrate to align with the centerline and applying an iron to the folded fabric to crease the fold.

4 Claims, 4 Drawing Sheets

METHOD AND TOOL FOR FORMING PICOTS

REFERENCE TO RELATED APPLICATION

This application claims the benefit of U.S. Provisional Application No. 61/223,606 filed Jul. 7, 2009.

BACKGROUND OF THE INVENTION

The present invention relates to a method and tool for forming picots, sometimes referred to as prairie points.

In many quilting, sewing, scrapbooking and other applications, it is common to provide decorative borders comprising generally triangular shaped elements formed of fabric. Such triangular shaped elements are commonly referred to as "picots" or "prairie points" and will hereinafter be referred to as "picots". The object into which the picots are being incorporated (i.e., the quilt, clothing, scrapbook, etc.) will be hereinafter referred to as the "work".

Traditionally, picots are formed by manually folding a square piece of fabric so as to form a triangle. In one method, a square piece of fabric is folded along a diagonal line between opposite corners, then folded in half again perpendicular to the original fold to create a folded triangle with all cut edges along one edge. In another method, a square piece of fabric is folded in half forming a rectangle, then the corners at the folds are brought to the center of the opposite long edge forming a triangle with folds meeting down the center and all cut edges along one edge. Once formed, the picot is typically ironed or pressed to impart defined edges and maintain its shape and one side of the picot is sewn or otherwise attached to one or more edges of the work. A succession of picots along an edge of the work provides a decorative border for the work. The most esthetically pleasing (and therefore desirable) decorative edge is one in which the picots are uniform in size and shape.

Manually forming picots in the manner described above is time consuming and often results in a lack of uniformity. Lack of uniformity is caused by the edges of the fabric not being aligned properly when folded and ironed, causing gaps between edges of the folded fabric, irregular or uneven shapes, or differently sized picots. In such cases, the decorative effect of the border is lessened by the irregular and uneven picots forming the border.

In addition, manually holding the fold in a picot during the ironing process is difficult and potentially dangerous. A steam iron, which is the preferred method for holding a fold when using cotton fabrics, cannot be used due to the risk of burns from steam from the iron. To address that problem, it has been known to use a metal ruler or other scale to hold the fold while ironing, but the metal itself may become heated and burn the user. Metallic pins have been used to hold the fold while ironing, but this method often results in misalignment of the edges during the ironing process and the pins leave imprints once removed, causing the picot to have to be ironed a second time to remove the imprints.

BRIEF SUMMARY OF THE INVENTION

It is one object of the present invention to provide a method and tool for forming picots with properly aligned edges.

It is another object of the present invention to provide a method and tool for forming picots that are uniform in shape and size.

It is another object of the present invention to provide a method and tool for forming picots that are safe and easy to use.

It is a further object of the present invention to provide a method and tool for forming picots wherein a variety of differently sized picots can be formed using one tool.

To those ends, a tool for forming picots is provided comprising a right isosceles triangular substrate of having a bottom and two sides, indicia denoting a centerline extending from the point of intersection of the two sides to the midpoint of the bottom (the "centerline"), and parallel, spaced indicia extending generally parallel to the bottom of the substrate denoting the width of the base of the picots to be formed (the "width indicators"). Picots are formed by cutting a square piece of fabric twice as wide as the desired height of the picot to be formed, folding the square piece of fabric in half to form a rectangle, placing the substrate on the folded piece of fabric such that the point is positioned at the midpoint of the top folded edge of the fabric and the centerline extends parallel to and equidistant from the sides of the fabric, folding the top corners of the fabric over the substrate to align with the centerline, and applying an iron to the folded fabric to crease the folds. Picots so formed will be uniform in size and shape, and without any gaps or overlaps between edges.

DETAILED DESCRIPTION OF THE PREFERRED EMBODIMENT

Figure 1:
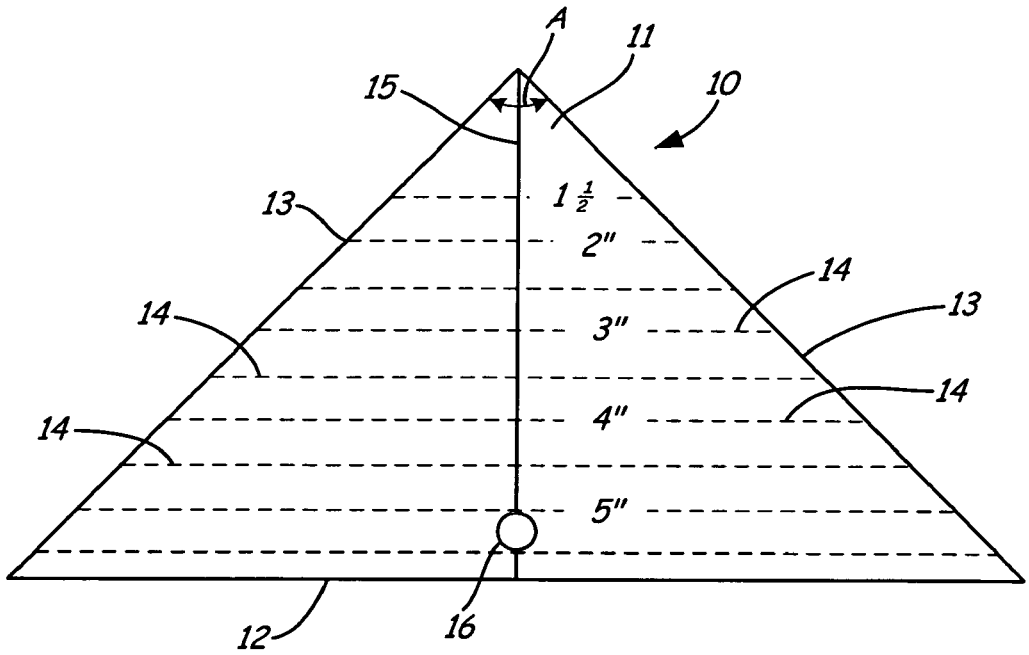
FIG. 1 is a top plan view of a tool according to the present invention.
Figure 2:
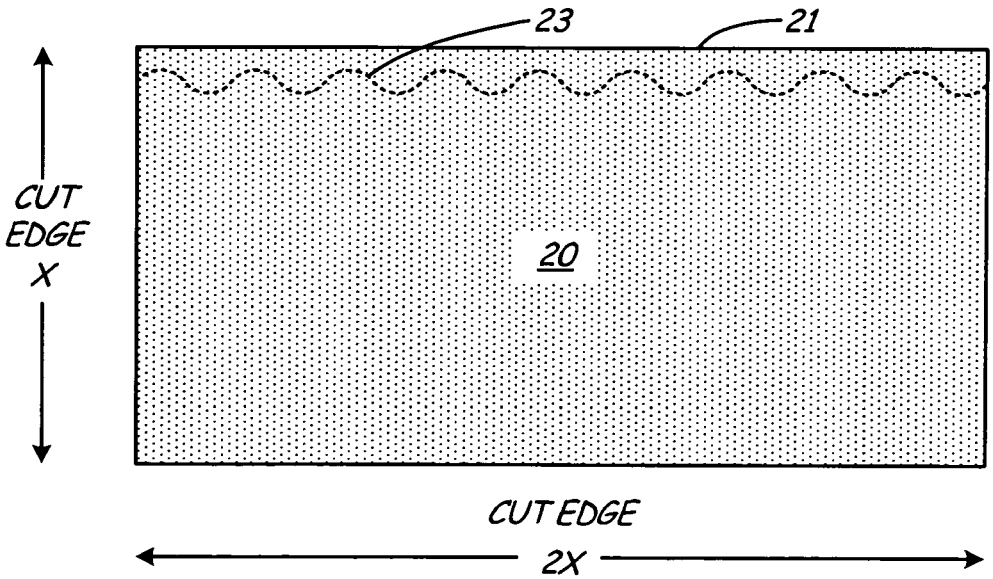
FIG. 2 is a top plan view of a folded fabric segment to be formed into a picot.

Referring to the drawing, wherein like numerals represent like elements throughout the several views, there is shown a picot forming tool generally designated by the numeral 10. Tool 10 comprises a triangular substrate 11 having a base 12 and sides 13. Substrate 11 is a right isosceles angle triangle wherein the angle A between the sides 13 is 90 degrees. Substrate 11 may be advantageously comprised of thin metal or other heat resistant material. Substrate 11 may also be advantageously coated with a coating such as Teflon® to facilitate its withdrawal from a picot once the picot has been formed and ironed.

One side of substrate 11 carries indicia including evenly spaced guidelines 14 parallel to base 12 and a centerline 15 extending from the point of intersection of sides 13 (or the vertex of substrate 11) to the midpoint of base 12. Guidelines 14 are labeled at intervals to indicate the width of guidelines 14.

A hole 16 is defined in substrate 11 along centerline 15 spaced from base 12 to facilitate grasping of substrate 11 or attachment of a string, ribbon or wire (not shown) which may be used to pull the tool from the picot once formed.

Figure 3:
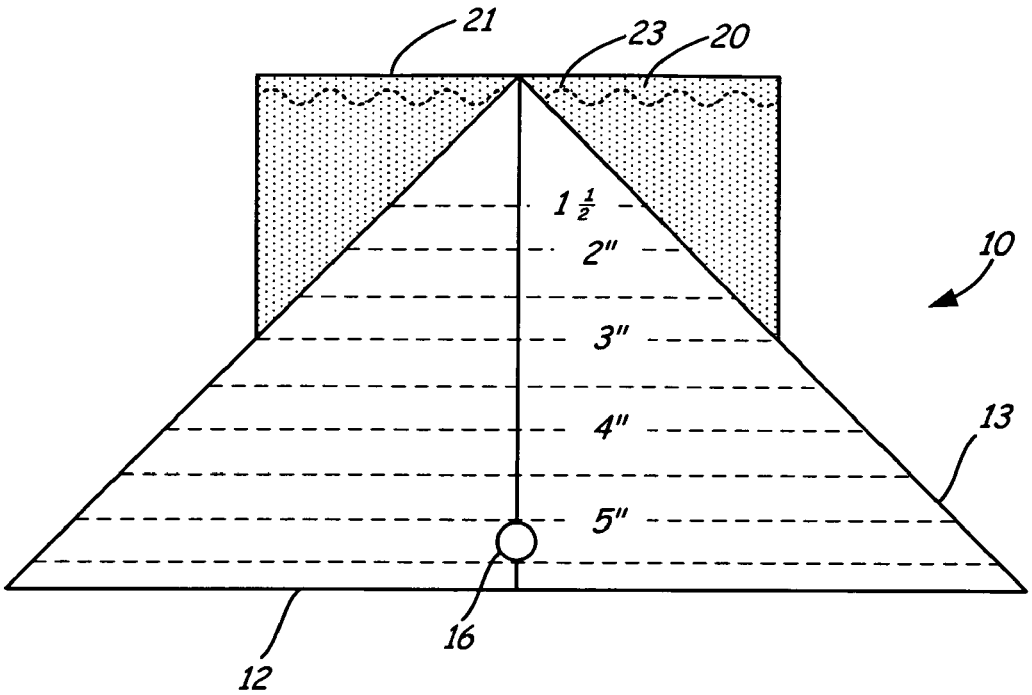
FIG. 3 is a top plan view of a tool according to the present invention showing the fabric segment prior to folding into a picot.
Figure 4:
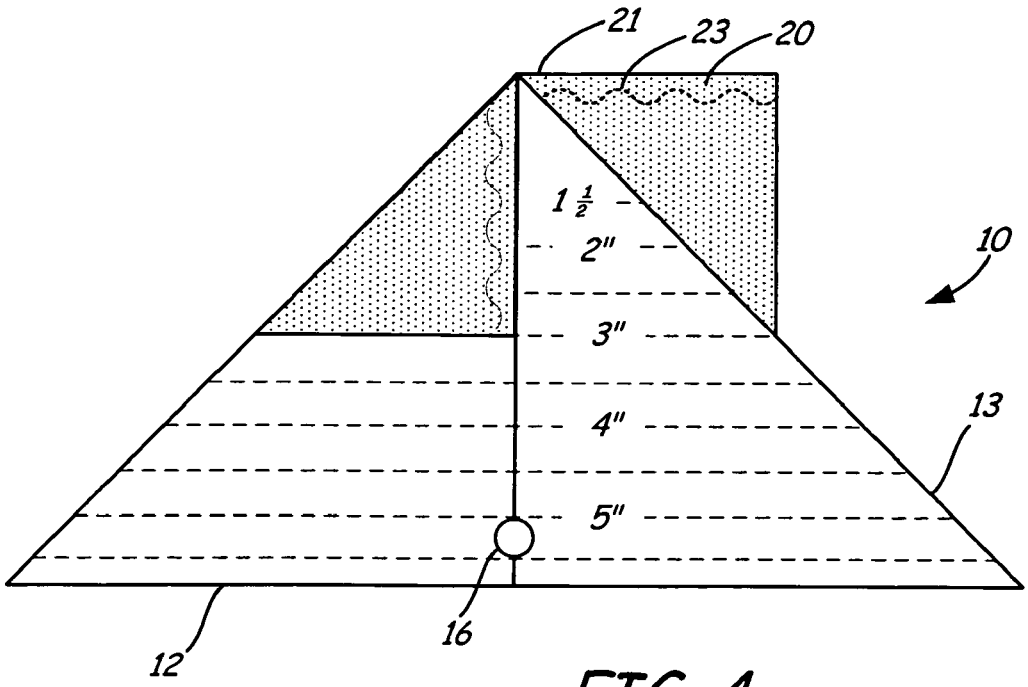
FIG. 4 is a top plan view of a tool according to the present invention showing the fabric segment partially folded into a picot.
Figure 5:
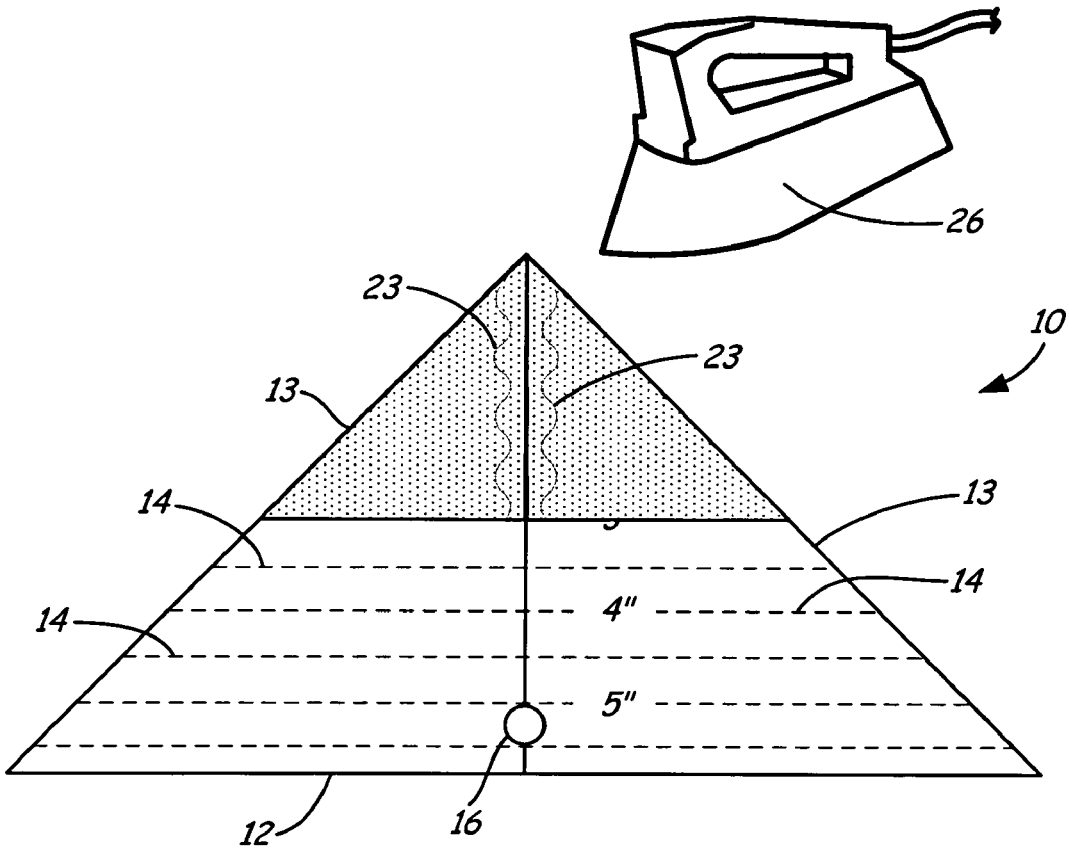
FIG. 5 is a top plan view of a tool according to the present invention showing the fabric segment fully folded into a picot and about to be ironed.

In use, as best seen in FIGS. 3, 4 and 5, a folded square of fabric segment 20 having at least one finished edge 21 is placed on a flat work surface. The finished edge 21 is generally formed by folding the fabric back against itself to form a hem, which may be sewn in place. Tool 10 is placed over the fabric segment 20 with its apex positioned at the midpoint of the finished edge 21 of the fabric segment 20 and registering bottom corners of the fabric segment 20 with the appropriate guideline 14, thereby assuring that the bottom of the fabric segment 20 is parallel with the base 12. The upper edges of the fabric segment 20 are folded to the centerline 15 to form a picot. An iron 26 is then applied to the top of the folded picot to hold its shape, and tool 10 is removed from the picot. Upon removal of tool 10 from the picot, the iron 26 is pressed onto the picot for a sufficient time to press the folded edges of the picot (usually on the order of 5 to 10 seconds for cotton fabrics and less for more delicate fabrics). The heat and steam from the iron 26 will set the folded edges of the picot and thereby maintain its shape.

Because substrate 11 is a right isosceles triangle, it will be seen that the distance along centerline 15 to any given guideline 14 will be exactly one-half the width of that guideline 14. Thus, the size (i.e., height and width) of picots formed using tool 10 can be controlled uniformly by using a fabric segment 20 having a width equal to the desired width of the picot and aligning the bottom edge of the fabric segment 20 with the desired guideline 14. To form a picot having a predetermined size, the width of the fabric segment 20 is determined by the formula "width=(finished height+seam allowance)×2". The following chart illustrates the amount of fabric needed to create picots ranging from ½ inch to 2½ inches in height and the number of such picots that can be formed from a specific amount of fabric.

CHART 1

HOW MANY PRAIRIE POINTS CAN I GET FROM MY FABRIC?

| PP Finished Height | PP Cut Size w/ ¼" Seam | # Per Fat Quarter (18" × 22") | # Per Half Yard (18" × 44") | # Per Yard (36" × 44") |
|---|---|---|---|---|
| ½" | 1½" | 143 | 286 | 598 |
| ¾" | 2" | 72 | 160 | 323 |
| 1" | 2½" | 49 | 112 | 210 |
| 1¼" | 3" | 30 | 65 | 143 |
| 1½" | 3½" | 25 | 55 | 110 |
| 1¾" | 4" | 16 | 40 | 72 |
| 2" | 4½" | 12 | 24 | 56 |
| 2¼" | 5" | 12 | 24 | 49 |
| 2½" | 5½" | 9 | 21 | 42 |

For instance, to create a picot having a height of 1½ inches and a seam allowance of ¼ inch, the width of the fabric should be (1½+¼)×2=3½ inches. A chart similar to that shown in Chart 1 may be attached to the back of tool 10 or included with tool 10 or its packaging.

Figure 6:
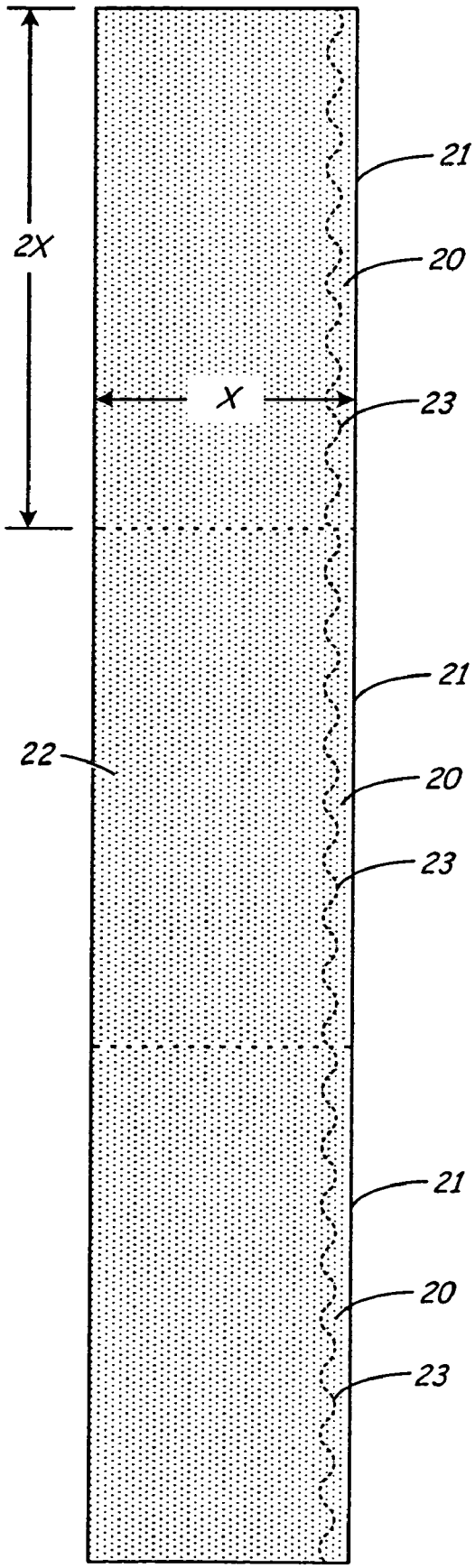
FIG. 6 is a top plan view of a folded strip of fabric to be cut into segments to form picots.

As best seen in FIG. 6, to form appropriately sized fabric segments 20, a strip of fabric 22 is provided having at least one finished edge 21 formed as described above. The strip of fabric 22 is cut to a transverse dimension X which is equal to the desired height (or two times the desired width) of the picot to be formed. Once the strip of fabric 22 is formed, it is cut into fabric segments 20 having a longitudinal dimension 2X equal to twice transverse dimension X. The fabric segments 20 so formed are then ready to be formed into picots of uniform size.

Figure 7:
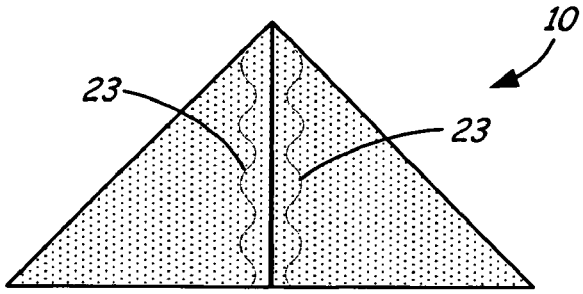
FIG. 7 is a top plan view of a picot formed according to the present invention having a decorative border.

As seen in FIG. 7, a more decorative picot can be provided by providing a strip of fabric 22 with decorative stitching 23 sewn into the finished edge 21.

While I have described the preferred embodiment of the invention, it will be apparent to those skilled in the art that other embodiments are possible within the scope of the invention.

What is claimed is:

1. A tool for forming picots comprising:

(a) a right isosceles triangular substrate having a base defining a base edge and two sides each defining a side edge, said side edges intersecting at an apex;

(b) indicia on said substrate defining a centerline extending from said apex of said triangular substrate to the midpoint of said base; and (c) indicia on said substrate defining one or more guidelines extending from one of said sides of said triangular substrate to the other of said sides and being parallel to said base edge.

2. A tool for forming picots according to claim 1 wherein said indicia defining guidelines comprises numerals indicating the length of one or more of said guidelines.

3. A tool for forming picots comprising:

(a) a right isosceles triangular substrate having a base defining a base edge and two sides each defining a side edge, said side edges intersecting at an apex;

(b) a centerline defined on one side of said substrate extending from said apex to the midpoint of said base;

(c) one or more guidelines defined on said one side of said substrate comprising lines extending from one of said sides to the other parallel to said base edge; and (d) indicia on said substrate defining the length of one or more of said guidelines.

4. A method for forming picots comprising:

(a) placing a substrate comprising a right isosceles triangle having a base and two sides meeting at an apex on a rectangular strip of fabric having a width twice its height;

(b) aligning said substrate on said fabric such that said apex of said substrate is positioned at the midpoint of the top edge of said fabric and the bottom edge of said fabric is positioned parallel to the base of the substrate;

(c) folding the top edges of the fabric over the substrate to align with the centerline; and (d) applying an iron to the folded fabric to crease the fold.

* * * * *